US007260241B2

(12) United States Patent
Fukuhara et al.

(10) Patent No.: US 7,260,241 B2
(45) Date of Patent: Aug. 21, 2007

(54) IMAGE SURVEILLANCE APPARATUS, IMAGE SURVEILLANCE METHOD, AND IMAGE SURVEILLANCE PROCESSING PROGRAM

(75) Inventors: Yoshio Fukuhara, Saitama (JP); Kiyoshi Kumata, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 749 days.

(21) Appl. No.: 10/167,258

(22) Filed: Jun. 11, 2002

(65) Prior Publication Data

US 2002/0196962 A1 Dec. 26, 2002

(30) Foreign Application Priority Data

Jun. 12, 2001 (JP) ..... 2001-177810

(51) Int. Cl.
*G06K 9/00* (2006.01)
*H04N 7/18* (2006.01)

(52) U.S. Cl. ..... 382/103; 348/143

(58) Field of Classification Search ..... 348/36, 348/143; 382/103
See application file for complete search history.

(56) References Cited

U.S. PATENT DOCUMENTS 3,823,261 A * 7/1974 Bolsey ..... 348/154
4,408,224 A * 10/1983 Yoshida ..... 348/155
4,679,077 A 7/1987 Yuasa et al.
5,033,101 A * 7/1991 Sood ..... 382/209
5,185,667 A * 2/1993 Zimmermann ..... 348/207.99
5,243,418 A 9/1993 Kuno et al.
5,455,561 A 10/1995 Brown
5,790,181 A 8/1998 Chahl et al.
6,215,519 B1 4/2001 Nayar et al.
6,243,131 B1 * 6/2001 Martin ..... 348/36
6,456,321 B1 * 9/2002 Ito et al. ..... 348/143

(Continued)

FOREIGN PATENT DOCUMENTS

EP 0 967 584 A2 12/1999

(Continued)

OTHER PUBLICATIONS

T. Yamamoto et. al., "Electric Curtain for Security," Proceedings of the 6th Symposium on Sensing via Image Information, Image Sensing Technology Society, Jun. 2000.

*Primary Examiner*—Joseph Mancuso
*Assistant Examiner*—Hadi Akhavannik
(74) *Attorney, Agent, or Firm*—David G. Conlin; Steven M. Jensen; Edwards Angell Palmer & Dodge LLP

(57) ABSTRACT

An image surveillance apparatus includes: an imaging section including a convex mirror having a shape of a body of rotation, the imaging section obtaining an image of an omniazimuthal region and generating image data of the omniazimuthal region; a surveillance region setting section for setting a surveillance region in the image data of the omniazimuthal region which is obtained from the imaging section; an image processing section for performing image processing according to determination information obtained from a comparison/determination between background image data obtained by the imaging section in advance, which is used as a reference that represents a normal state of the surveillance region, and current image data obtained by the imaging section at a predetermined time interval; and a surveillance information output section for outputting surveillance information according to the determination information.

16 Claims, 14 Drawing Sheets

U.S. PATENT DOCUMENTS

| | | | | |
|---|---|---|---|---|
| 6,707,486 | B1 * | 3/2004 | Millet et al. | 348/155 |
| 6,876,762 | B1 * | 4/2005 | Ono | 382/154 |
| 2001/0052933 | A1 * | 12/2001 | Nybo et al. | 348/207 |
| 2002/0028019 | A1 * | 3/2002 | Hemiari et al. | 382/190 |
| 2003/0227548 | A1 * | 12/2003 | Kawakami et al. | 348/152 |

FOREIGN PATENT DOCUMENTS

| | | |
|---|---|---|
| JP | 04-330576 | 11/1992 |
| JP | 07-262355 | 10/1995 |
| JP | 09-054823 | 2/1997 |
| JP | 10-117338 | 5/1998 |
| JP | 2000-253310 | 9/2000 |
| JP | 2000-341679 | 12/2000 |
| JP | 2001-114045 | 4/2001 |

* cited by examiner

1st method: designate center position

2nd method: designate four corner points (coordinates)

Designate four corner points (coordinates)

Designate two distances to set ring-shaped surveillance region

1st method: designate center position
2nd method: designate angles

IMAGE SURVEILLANCE APPARATUS, IMAGE SURVEILLANCE METHOD, AND IMAGE SURVEILLANCE PROCESSING PROGRAM

BACKGROUND OF THE INVENTION

1. Field of the Invention

The present invention relates to an image surveillance apparatus having an imaging device installed so as to observe a certain surveillance region, wherein an image obtained by this imaging device is processed in order to detect a person or object which intrudes into the surveillance region. The present invention further relates to an image surveillance method and an image surveillance processing program implemented in such an image surveillance apparatus.

2. Description of the Related Art

In recent years, an imaging device such as an industrial television camera (hereinafter "ITV camera"), or the like, has been used in surveillance apparatuses. These kind of surveillance apparatuses are installed at an appropriate place in a factory building. The surveillance apparatus monitors an image obtained by an imaging device of the surveillance apparatus. Such a surveillance apparatus has been effectively used for improving security of a factory building by detecting occurrence of an abnormal event and intrusion of criminals into the factory building.

As for a surveillance apparatus used for such an application, an image of a certain region to be monitored is obtained by an ITV camera installed on a ceiling, or the like, and the image obtained by the ITV camera is used as a surveillance image for surveilling the surveillance region. The surveillance apparatus compares the surveillance image of the surveillance region, which is captured by the ITV camera and updated every predetermined time (hereinafter, referred to as "current image"), with a surveillance reference image, which is a background constantly present in the surveillance region and which is previously stored in the surveillance apparatus (hereinafter, referred to as "background image"). If the current image differs from the background image, the surveillance apparatus determines that there is an intruder, or the like, in the surveillance region.

When the surveillance apparatus detects intrusion of an intruder as a result of the comparison between the current image and the background image, for example, the surveillance apparatus informs a surveillant or operator who is monitoring the surveillance region through the surveillance apparatus that an intruder is detected. The surveillant informed of that intrusion goes to the place in the surveillance region where intrusion was detected, or takes any necessary action.

However, in a conventional image surveillance apparatus, the angle of view of an imaging device is narrow, such that the surveillance region that is covered by a single imaging device is limited. Thus, when it is necessary to surveil a large surveillance region, a plurality of imaging devices have to be installed at appropriate positions so that the entire surveillance region can be covered by the imaging devices. Alternatively, an imaging device has to be movable so that a large surveillance region can be covered by the single imaging device.

SUMMARY OF THE INVENTION

According to one aspect of the present invention, an image surveillance apparatus includes: an imaging section including a convex mirror having a shape of a body of rotation, the imaging section obtaining an image of an omniazimuthal region and generating image data of the omniazimuthal region; a surveillance region setting section for setting a surveillance region in the image data of the omniazimuthal region which is obtained from the imaging section; an image processing section for performing image processing according to determination information obtained from a comparison/determination between background image data obtained by the imaging section in advance, which is used as a reference that represents a normal state of the surveillance region, and current image data obtained by the imaging section at a predetermined time interval; and a surveillance information output section for outputting surveillance information according to the determination information.

In one embodiment of the present invention, the surveillance information output section is an image output section.

In another embodiment of the present invention, the image processing section includes: an image comparison section for comparing the background image data and the current image data; a determination section for determining the presence/absence of an object to be examined based on a comparison result of the image comparison section; and an image conversion section for performing certain image conversion processing based on the determination result of the determination section.

In still another embodiment of the present invention, the surveillance region setting section sets a plurality of surveillance regions.

In still another embodiment of the present invention, the image processing section converts the image data of the omniazimuthal region, which is obtained by the imaging section, into panoramic image data or perspective converted image data.

In still another embodiment of the present invention, the image surveillance apparatus further includes an alarm information output section for outputting alarm information when the image processing section determines that the current image data is different from the background image data.

In still another embodiment of the present invention, the image comparison section generates comparison result image data based on a difference between the background image data and the current image data; and the determination section performs projection processing based on a comparison result for each surveillance region.

In still another embodiment of the present invention, time information, which indicates the time when the background image data was obtained, is attached to the background image data.

In still another embodiment of the present invention, the image data obtained by the imaging section is circular image data; and the surveillance region is set based on a polar coordinate system where a center of the circular image data is an origin of the system.

In still another embodiment of the present invention, the image data obtained by the imaging section is circular image data; and a ring-shaped region is set as the surveillance region by designating two distances from a center of the circular image data.

In still another embodiment of the present invention, the image data obtained by the imaging section is circular image data; and a pair of symmetric regions are set as the surveillance regions by designating two distances from a center of the circular image data and two central angles.

According to another aspect of the present invention, there is provided an image surveillance method using an imaging section which includes a convex mirror having a shape of a body of rotation, the imaging section obtaining an image of an omniazimuthal region, comprising: a surveillance region setting step of setting a desired surveillance region in omniazimuthal image data obtained by the imaging section; a background image setting step of setting a plurality of image data obtained by the imaging section as background image data which are used as a reference that represent a normal state of the surveillance region; and a surveillance step of surveilling the presence/absence of an abnormal event in the surveillance region based on a comparison result between the plurality of background image data and current image data obtained by the imaging section at a predetermined time interval.

In one embodiment of the present invention, the image surveillance method further includes a background image update step of updating the background image data when a predetermined time has elapsed after the setting of the background image data based on the predetermined elapsed time.

In another embodiment of the present invention, the surveillance step includes: a difference-binarized image generation step of acquiring the current image data obtained at a predetermined time interval, and generating difference-binarized image data based on a comparison performed for each surveillance region between the current image data and the background image data; a projection step of performing projection processing on the difference-binarized image data for each surveillance region; a maximum value calculation step of summing up data obtained by the projection processing and calculating a maximum value of the summed-up result; a determination step of determining whether or not the calculated maximum value is greater than a predetermined threshold value; and an alarming step of outputting at least an alarm or converted image data produced from current image data in a certain region when it is determined that the calculated maximum value is greater than the predetermined threshold value.

In still another embodiment of the present invention, the image surveillance method further includes a storage step of storing the current image data as a background image candidate in a storage section when it is determined in the determination step that the calculated maximum value is not greater than the predetermined threshold value.

According to still another aspect of the present invention, there is provided an image surveillance processing program for executing the above image surveillance method.

In this specification, "omniazimuth" refers to a 360° view field area.

Thus, the invention described herein makes possible the advantages of: (1) providing an image surveillance apparatus which can surveil a large surveillance region with a single imaging device such that an intruder, or the like, which intrudes into the surveillance region can be reliably detected; and (2) providing an image surveillance method and an image surveillance processing program implemented in such an image surveillance apparatus.

These and other advantages of the present invention will become apparent to those skilled in the art upon reading and understanding the following detailed description with reference to the accompanying figures.

BRIEF DESCRIPTION OF THE DRAWINGS

FIGS. 4(*b*) through 4(*d*) show image data obtained by the omniazimuthal camera of the present invention, and converted images produced from the image data obtained by the omniazimuthal camera.

DESCRIPTION OF THE PREFERRED EMBODIMENTS

Hereinafter, an image surveillance apparatus of the present invention will be described with reference to the drawings.

The image surveillance apparatus of the present invention includes an imaging section capable of obtaining an image of a large area region.

The imaging section is installed at a place in a factory building, for example, where an intrusion of an intruder has to be prevented, so as to cover a certain surveillance region in such a place. If an intrusion of an intruder is detected by the imaging section, an image obtained by the imaging section is subjected to a certain processing, so that the processed image is displayed on a monitor or the like. On the other hand, some output processing which is necessary for security, such as a generation of an alarm sound, alarm signal, or the like, is performed by the surveillance apparatus.

Operation modes of the image surveillance apparatus include a security mode and a deactivated mode. In a normal state, the image surveillance apparatus is set to the security mode. In the security mode, it is checked whether or not there is an intruding object or person in an image obtained by the imaging section. (Hereinafter, such a security status is referred to as "surveillance status".) In the security mode, if an intruder is detected ("abnormal status"), a necessary operation, such as a generation of an alarm sound, is performed. (The status where no intruder is detected is referred to as "normal status".) The deactivated mode is selected, for example, when a surveillant is placed at an area to be surveilled, and accordingly, it is not necessary to produce an alarm sound, or when the surveillance system has to be stopped for maintenance of the factory plant or the like.

Figure 1:
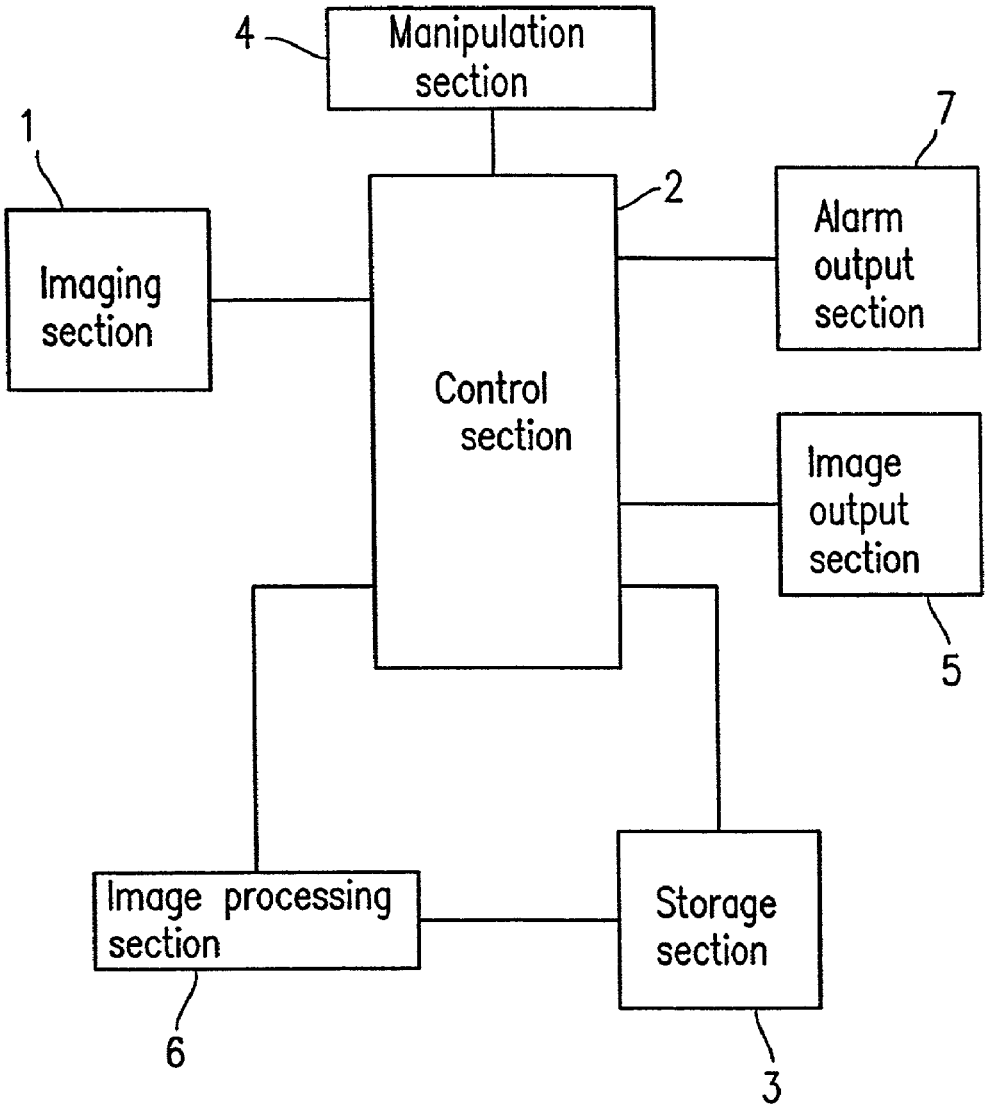
FIG. 1 is a block diagram showing a general structure of an image surveillance apparatus according to one embodiment of the present invention.

FIG. 1 is a block diagram showing an image surveillance apparatus according to one embodiment of the present invention.

The image surveillance apparatus includes: an imaging section 1 for capturing an image of a certain surveillance region and obtaining image data from the captured image; a control section 2 for controlling the entire operation of the image surveillance apparatus; a storage section 3 for storing a control program, the image data, etc.; a manipulation section 4 for setting the surveillance region or changing setting conditions which are used for setting the surveillance region; an image processing section 6 for producing a perspective converted image, a panoramic image of the entire surveillance region, or the like, based on latest image data of the surveillance region including an alien object, when the surveillance apparatus detects an occurrence of an abnormal event in the image data obtained by the imaging section 1; an image output section 5 for outputting a converted image, or the like, produced by the image processing section 6; and an alarm output section 7 for outputting alarm information, such as an alarm sound, an alarm message, or the like, which are generated in conjunction with the surveillance region when the surveillance apparatus detects an occurrence of an abnormal event based on the image data obtained by the imaging section 1.

The control section 2 is, for example, a central processing unit (CPU), to which the imaging section 1, the storage section 3, the manipulation section 4, the image output section 5, the image processing section 6, and the alarm output section 7 are connected.

The control section 2 obtains a control program stored in the storage section 3, so as to control the imaging section 1, the image output section 5, the image processing section 6, and the alarm output section 7.

The imaging section 1 obtains an image of a certain surveillance region under the control of the control section 2. Specifically, the imaging section 1 obtains a plurality of current images which are obtained as image data every predetermined time during a surveillance step. On the other hand, the imaging section 1 obtains a plurality of background images for comparison with the current images, at predetermined different times before the surveillance step begins. The image data of the obtained background images and image data of the current images are transmitted to the storage section 3 via the control section 2 and the image processing section 6 every time such image data is obtained, and stored respectively in a background image storage region 15 and a current image storage region 16, which will be described later in connection with FIG. 3.

The imaging section 1 is formed by an imaging device capable of obtaining a large view field image. For example, an omniazimuthal camera, which is formed by a convex mirror having a shape of a body of rotation (i.e., a shape formed of a rotated body) and an imaging camera for capturing an image reflected in the convex mirror, can be used as the imaging device of the imaging section 1. In the omniazimuthal camera, the convex mirror is placed in front of the imaging camera such that a convex surf ace of the mirror faces the imaging camera, and the conical mirror and the imaging camera are fixed such that the rotation axis of the conical mirror is identical with an optical axis of a lens of the imaging camera.

A CCD imaging element, which is usually used in an industrial camera, can be used in a camera section of the omniazimuthal camera. Alternatively, an infrared camera, a visual light camera, etc., may be used according to the type of an object to be surveilled. As the convex mirror having a shape of a body of rotation, a conical mirror, a spherical mirror, a paraboloidal mirror, a hyperboloidal mirror, a spheroidal mirror, etc., may be used, because a mirror having such a shape can readily convert an image reflected in the mirror into a perspective converted image which is assumed as being seen from a focal point of the mirror.

Figure 2:
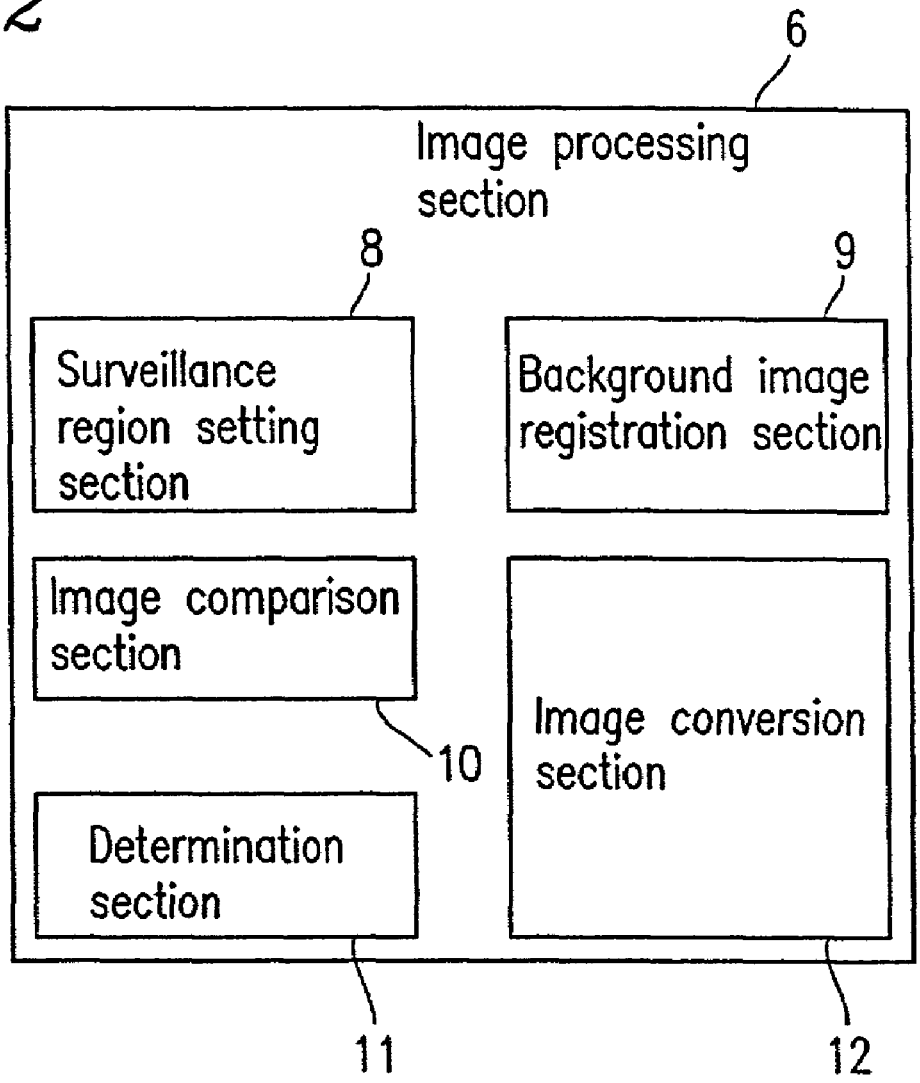
FIG. 2 is a block diagram showing a structure of an image processing section of an image surveillance apparatus of the present invention.

FIG. 2 shows a general structure of the image processing section 6 of the image surveillance apparatus of the present invention. As shown in FIG. 2, the image processing section 6 includes a surveillance region setting section 8 capable of setting a plurality of desired surveillance regions over a displayed image, and a background image registration section 9 for adding, to image data obtained by the imaging section 1, time information which indicates the time when the image data was obtained, and transferring such image data into the storage section 3. The image processing section 6 further includes an image comparison section 10 for comparing current image data, which is obtained by the imaging section 1 every predetermined time, with background image data obtained from the storage section 3. Based on a difference between the current image data and the background image data at the image comparison section 10, a determination section 11 determines whether the current image data of the surveillance region is normal or not. If the determination result at the determination section 11 is not normal, a perspective converted image, or the like, to be displayed is produced by an image conversion section 12 so as to include an object to be examined.

Figure 4:
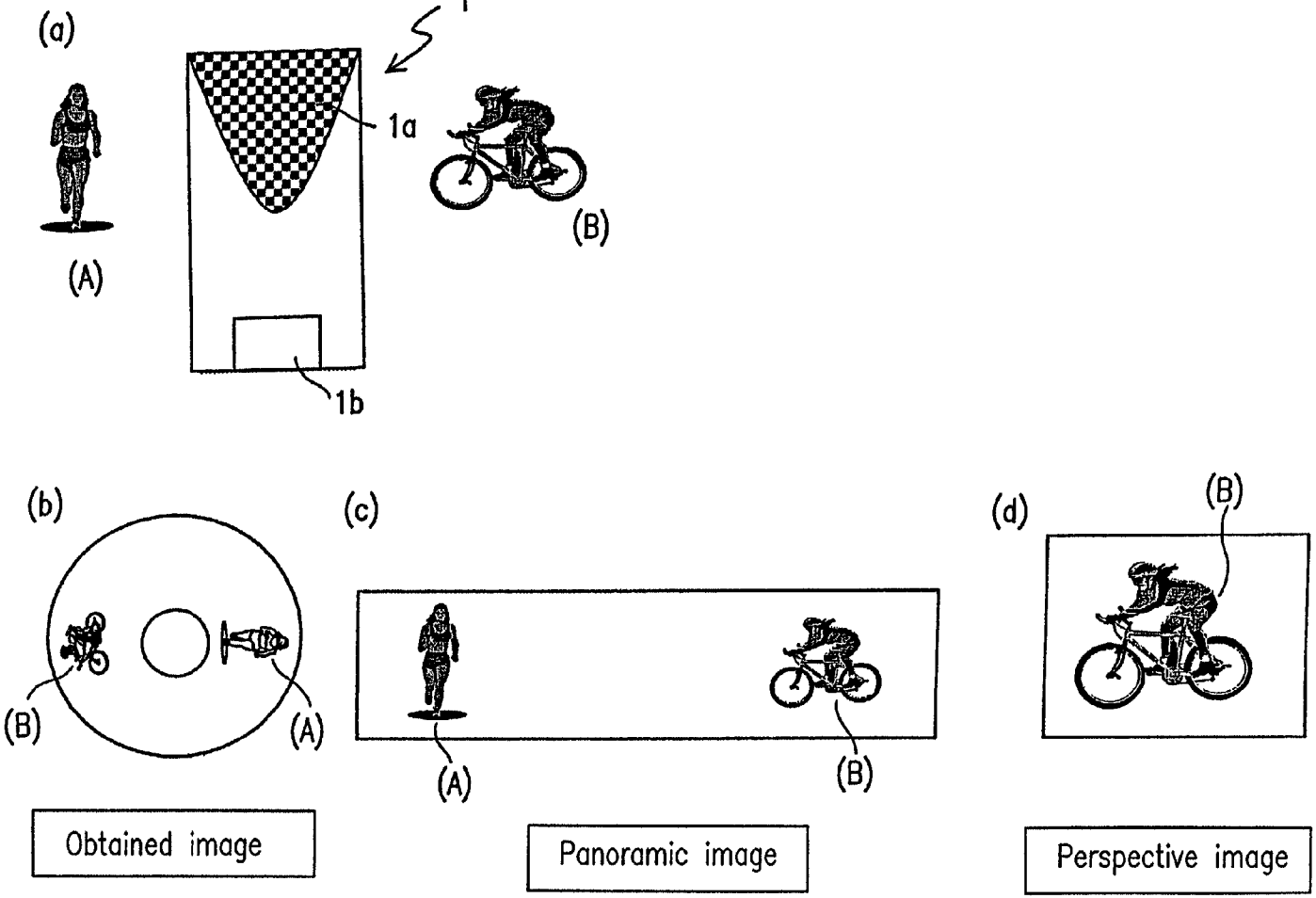
FIG. 4(*a*) shows a general structure of an omniazimuthal camera of the present invention, and objects which are present within a view field of the omniazimuthal camera.

FIG. 4(*a*) shows a general structure of an omniazimuthal camera of the imaging section 1, and objects (A) and (B) which are present with in the view field of the omniazimuthal camera. FIGS. 4(*b*) through 4(*d*) show image data obtained by the omniazimuthal camera of the imaging section 1, and converted images produced by the image conversion section 12 from the image data obtained by the omniazimuthal camera.

Referring to FIG. 4(*a*), the imaging section 1 is formed by an omniazimuthal camera, which includes a hyperboloidal mirror 1*a* installed such that a convex surface thereof extends downward, and a CCD camera 1*b* positioned just below the hyperboloidal mirror 1*a*. In the example shown in FIG. 4(*a*), the objects (A) and (B) are within the view field (surveillance region) of the imaging section 1.

FIG. 4(*b*) shows an image obtained by the omniazimuthal camera of the imaging section 1, which includes images of the objects (A) and (B) of FIG. 4(*a*). An image obtained by the omniazimuthal camera is a circular image as shown in FIG. 4(*b*).

FIG. 4(*c*) shows a panoramic image which is obtained by panoramically converting the circular image of FIG. 4(*b*). FIG. 4(*d*) shows a perspective converted image which is obtained by perspectively converting the circular image of FIG. 4(*b*).

Figure 3:
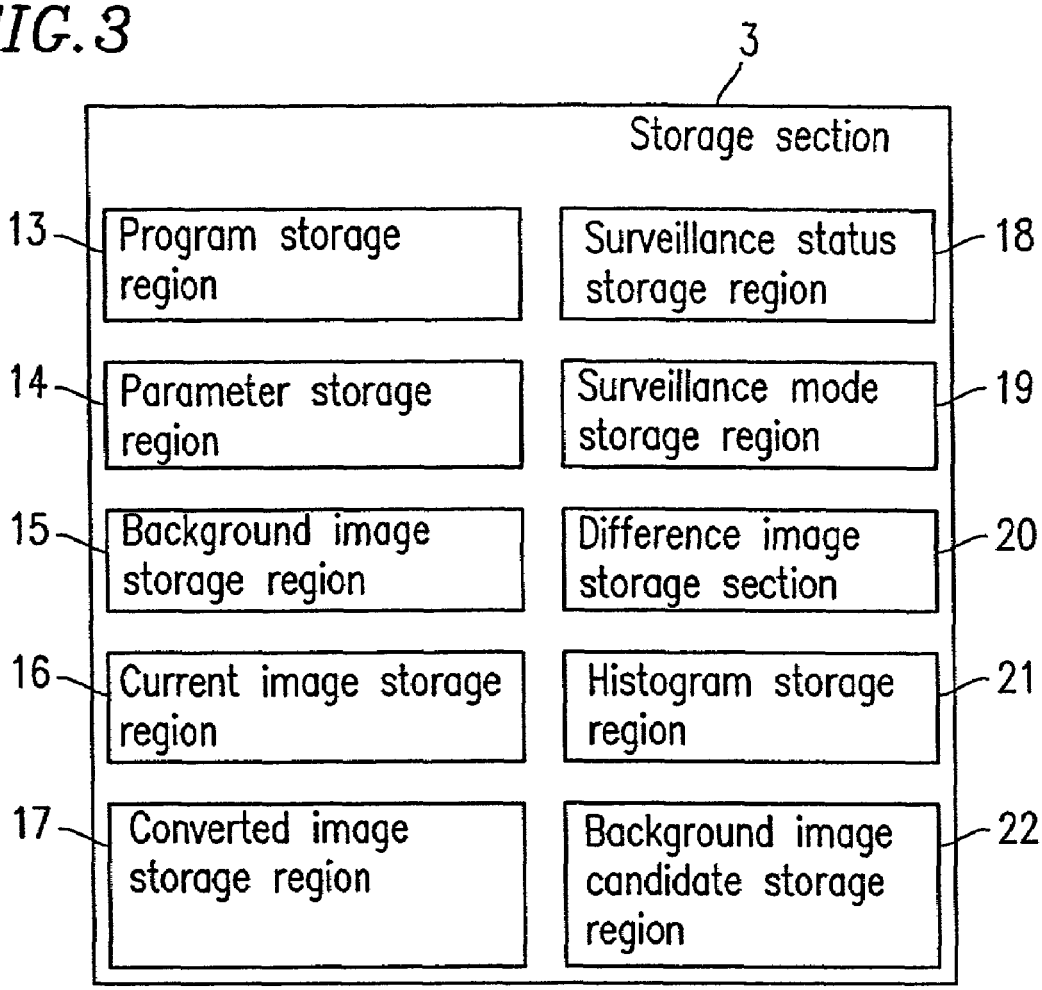
FIG. 3 is a block diagram showing a structure of a storage section of an image surveillance apparatus of the present invention.

FIG. 3 is a block diagram showing a structure of the storage section 3. The storage section 3, which is connected to the control section 2 (see FIG. 1), may be formed by a magnetic recording device, such as a hard disc or the like. Alternatively, the storage section 3 may be formed by a semiconductor memory, such as a RAM (Random Access Memory) which can achieve high-speed processing.

The storage section 3 includes: a program storage region 13 for storing operation programs for the control section 2, the image processing section 6, etc.; a parameter storage region 14 for storing various parameters, such as information regarding a surveillance region, a binary threshold value used as a reference for comparison between a background image and a current image (which will be described later), abnormality determination reference value used for determining an occurrence of an abnormal event, etc.; a background image storage region 15 for storing a plurality of background image data which are obtained by the imaging section 1 in advance and which are reference images to be compared with a current image; a current image storage region 16 for storing current image data obtained by the imaging section 1; a converted image storage region 17 for storing a converted image produced by the image processing section 6 based on a current image obtained by the imaging section 1; a background image candidate storage region 22 for storing a background image candidate (which will be described later); a surveillance status storage region 18 for storing a surveillance status (normal or abnormal); a surveillance mode storage region 19 for storing a surveillance mode of the image surveillance apparatus (security mode, deactivated mode, or the like); a difference image storage section 20 for storing a binary difference image which represents a difference between the compared images (which will be described later); and a histogram storage region 21 for storing histogram data concerning an abnormal portion in the difference image (which will be described later).

Referring again to FIG. 1, the image surveillance apparatus is described.

The alarm output section 7 is connected to an external controller (not shown) via a wire or wireless means, and outputs an alarm to the external controller when an abnormal event occurs.

The image output section 5 has a display screen, such as a monitor. The image output section 5 is connected, via a wire or wireless means, to a controller of an external device used for surveillance which is provided out of the image surveillance apparatus, i.e., a controller of a communication device (now shown), such as a communication device installed in a guardhouse in which a surveillant is present, a communication device a surveillant always carries with him/her, or the like. When an abnormal event occurs, converted image data of a surveillance region including an object to be examined, unconverted image data of the surveillance region, etc., are output to the controller of the communication device.

The manipulation section 4 has key switches which allow a key entry on a display screen of the image output section 5. For example, the key switch is a keyboard provided together with the monitor of the image output section 5. Alternatively, the key switch may be a touch panel formed over the monitor screen which is provided together with the controller. The manipulation section 4 outputs an instruction signal which is generated according to a manipulation of a surveillant to the control section 2 through a communication line (not shown).

Next, a general procedure of a surveillance operation for surveilling a surveillance region using the image surveillance apparatus of the present invention is described.

Figure 5:
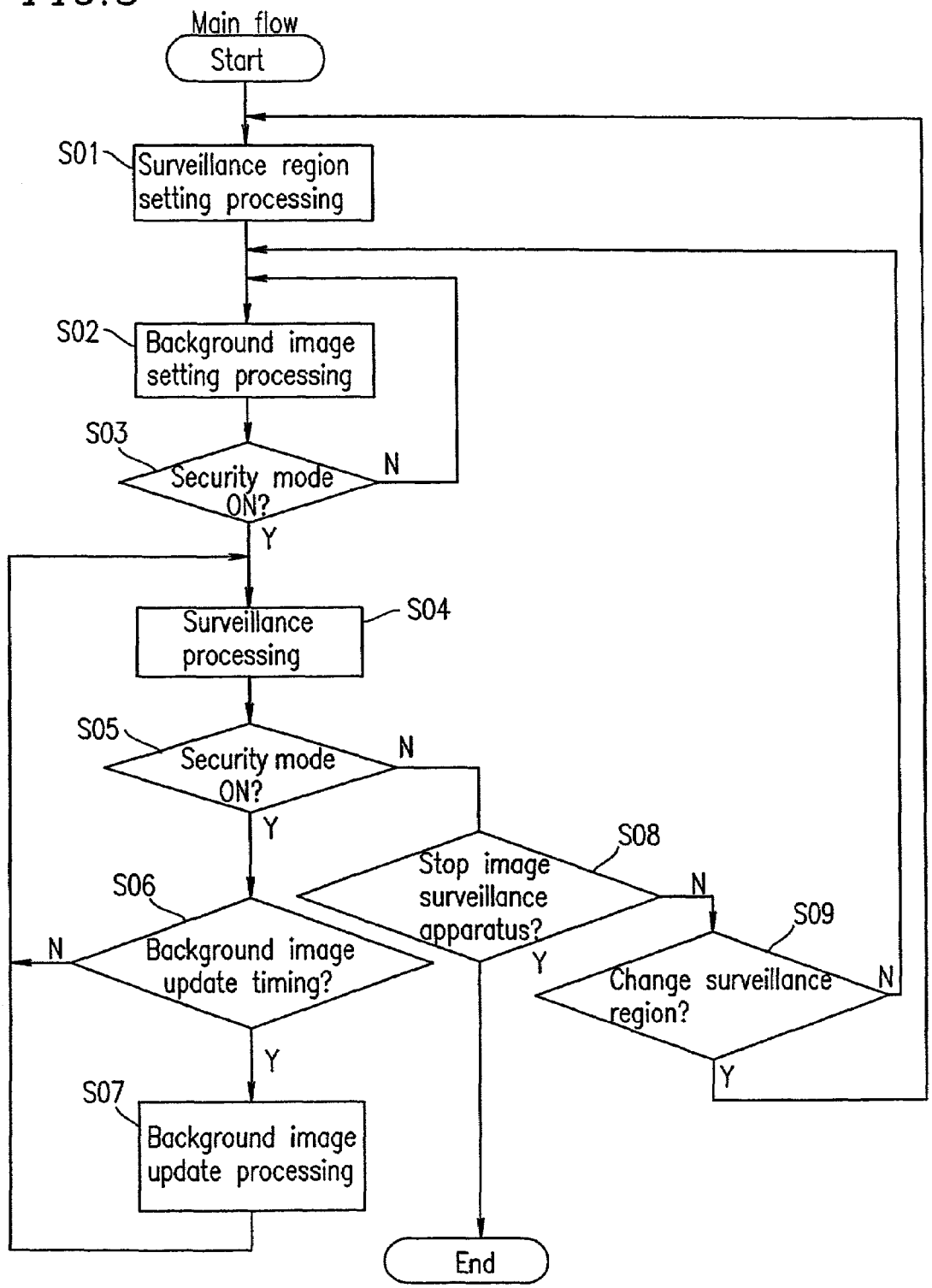
FIG. 5 is a flowchart illustrating a general procedure of a surveillance operation using an image surveillance apparatus of the present invention.

FIG. 5 is a flowchart illustrating a general procedure of a surveillance operation using the image surveillance apparatus of the present invention.

A general processing flow of the image surveillance apparatus of the present invention is described with reference to FIG. 5.

The processing flow of the image surveillance apparatus of this embodiment is generally formed by four processing steps including a surveillance region setting step, a background image setting step, a surveillance step, and a background image update step.

At the first step, i.e., at the surveillance region setting step, a surveillant sets a region in an image displayed on the display screen of the image output section 5 as a surveillance region by manipulating the manipulation section 4 (step S01). At this step, a plurality of regions can be surveilled by setting the plurality of regions as surveillance regions.

After the setting of a certain surveillance region, setting processing for a background image is performed at the background image setting step (step S02).

In the background image setting processing at step S02, for example, the surveillant, who is surveilling the surveillance region, manipulates the manipulation section 4, such that image data, which is obtained by the imaging section 1, is stored in the background image storage region 15 of the storage section 3 (FIG. 3) by units of an image data segment having a frame number of N (one background image unit). Thereafter, updating of the background image unit is continued until the process proceeds to the surveillance step.

After the background image setting processing (step S02) has been completed, at security mode determination step (step S03), it is determined whether the security mode of the image surveillance apparatus is ON or OFF. If the security mode is ON, the process transits from the background image setting step to the surveillance step. If the security mode is OFF, the process returns to the background image setting processing of step S02, and updating of the background image unit is continued. In this example described herein, the frame number N is a plural number. However, a basic image comparison operation can be performed even when the frame number N is 1.

The transition from the background image setting step to the surveillance step is achieved by manipulation of the manipulation section 4 by the surveillant, who is surveilling the surveillance region, in a similar manner to that performed in transition from the surveillance region setting step to the background image setting step. The manipulation section 4 has an input switch for switching ON/OFF of the security mode of the image surveillance apparatus. This input switch is manipulated by the surveillant. Without a switch manipulation by the surveillance for turning the security mode ON, a transition instruction to the surveillance step is not issued, and the process returns to the background image setting step for updating the background image unit.

At the surveillance step (step S04), surveillance processing is performed. Specifically, during surveillance processing, current image data of one frame is compared with the background image unit, whereby occurrence of an abnormal event, such as an intrusion of an intruder, is surveilled. Surveillance processing will be described later in more detail.

After a single turn of the surveillance processing is completed, the process proceeds to a security mode determination step where the control section 2 determines whether the security mode of the image surveillance apparatus is ON or OFF (step S05). If the security mode is OFF, the process proceeds to a stop processing determination step where the control section 2 determines whether or not a stop signal is issued for stopping the operation of the image surveillance apparatus (step S08). This stop signal is output to the control section 2 by, for example, a switch manipulation by the surveillant who is surveilling the surveillance region. If the stop signal is output to the control section 2, the power to the image surveillance apparatus is turned off, whereby the processing is ended. If the stop signal is not output to the control section 2, the process proceeds to a surveillance region change instruction determination step where the control section 2 determines whether or not an instruction is issued for changing the surveillance region (step S09). Such an instruction for changing the surveillance region is issued by, for example, a switch manipulation by the surveillant who is surveilling the surveillance region. If the surveillance region change instruction is not issued, the process returns to the background image setting processing step of step S02. If the surveillance region change instruction is issued, the process returns to the surveillance region setting processing step of step S01.

At the security mode determination step (step S05), if the security mode is ON, the process proceeds to a background image update timing determination step where the control section 2 determines whether or not it is an appropriate time to update the background image unit (step S06). If the control section 2 determines that it is not an appropriate time to update the background image unit, the process returns to the surveillance step of step S04. If the control section 2 determines that it is an appropriate time to update the background image unit, the process proceeds to a background image updating step of step S07.

At the background image updating step, background image updating processing is performed (step S07). In the background image updating processing step, among the background images which are stored in the background image storage region 15 of the storage section 3 and which have a frame number of N, the control section 2 refers to the time information of each background image which indicates the time when the background image was obtained and selects the oldest background image. The selected background image is updated to a new background image. After the update processing has been completed, the process returns to the surveillance step of step S04.

The transition from the background image update processing step to the surveillance step is achieved by, for example, manipulation of the manipulation section 4. An instruction signal generated by manipulation of the manipulation section 4 is output to the control section 2. The control section 2 performs processing according to an instruction of the instruction signal.

Next, each of the above mentioned steps is described in more detail.

Figure 6:
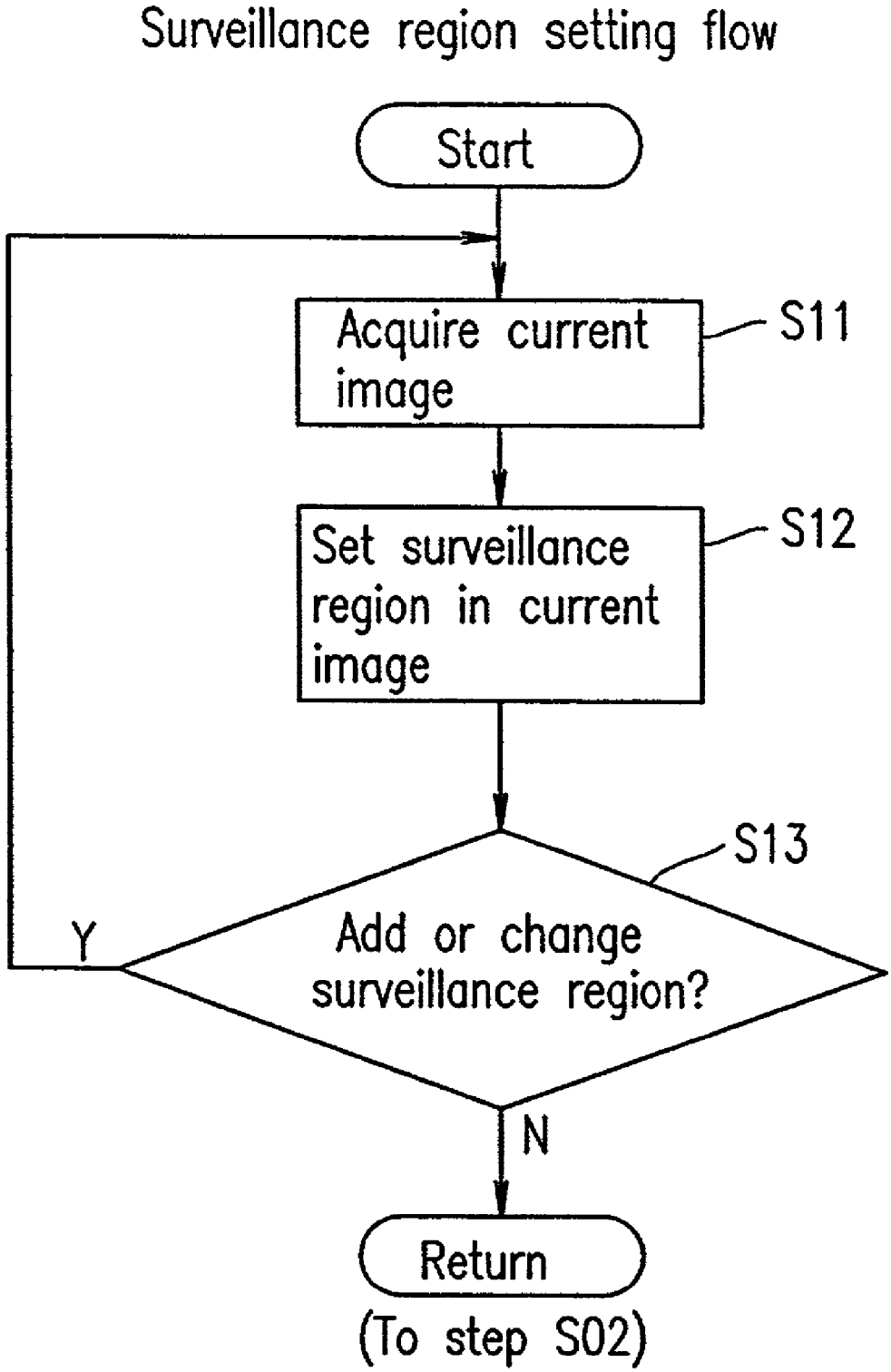
FIG. 6 is a flowchart which illustrates a general procedure of surveillance region setting processing.

FIG. 6 is a flowchart which illustrates a general procedure of the surveillance region setting processing of step S01.

In the surveillance region setting processing of step S01, at an image acquisition step, image data (captured data) of an image including a certain surveillance region which is captured by the imaging section 1 is stored in the current image storage region 16 of the storage section 3 through the control section 2 (step S11). Hereinafter, this process is simply expressed in a sentence which reads "a current image is acquired from the imaging section 1". In this processing, time information, which indicates the time when the captured data was obtained, is stored in the current image storage region 16 of the storage section 3 together with the captured data.

The obtained current image data is output from the control section 2 together with its time information to a monitor (not shown), which is provided together with a controller of an external device, through the image output section 5.

Then, at step S12, a surveillant who is observing the monitor sets a surveillance region in an image displayed on the monitor according to a surveillance region setting method (which will be described later), and the set surveillance region information is stored in the parameter storage region 14 of the storage section 3.

After the surveillance region setting processing at step S12 has been completed, the process proceeds to step S13, where a message for asking the surveillant whether or not he/she wants to issue an instruction to add another surveillance region or change the surveillance region. If the surveillant wants to issue an instruction to add another surveillance region or change the surveillance region, the surveillant inputs such an instruction through the manipulation section 4. The instruction input by the surveillant is transmitted to the control section 2.

If an instruction to add another surveillance region or change the surveillance region is issued, the process returns to the current image acquisition step of step S11, where the surveillance region setting processing is continued by the surveillance region setting section 8. If an instruction to add another surveillance region or change the surveillance region is not issued, the process of FIG. 6 proceeds to the background image setting processing at step S2 in the main flow of FIG. 5.

Now, a specific example of the above-mentioned surveillance region setting method is described.

Figure 7:
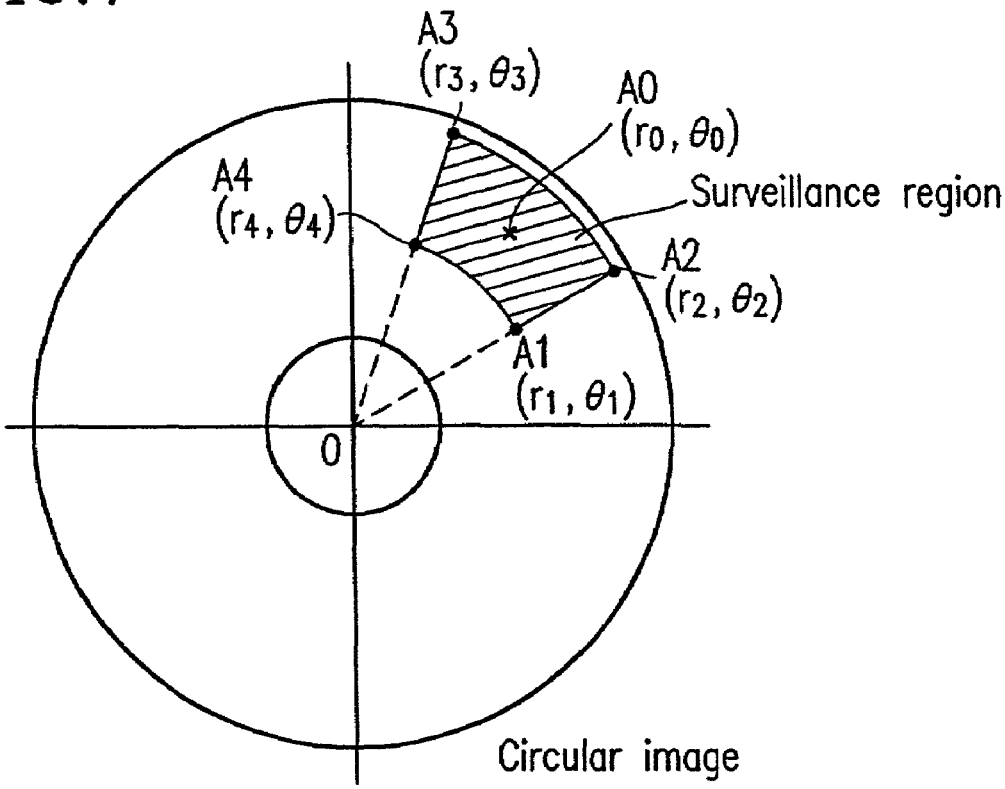
FIG. 7 illustrates a first example of the surveillance region setting processing.

FIG. 7 schematically shows a circular captured image obtained by an omniazimuthal camera which is used as the imaging section 1. First and second methods for setting a surveillance region are described below with reference to FIG. 7.

According to the first method, in a process for setting a surveillance region in the circular captured image, a coordinate of the center of the surveillance region (e.g., A0 (r0, θ0)) is designated by a key entry through the manipulation section 4. In this method, a predetermined area of region is set around the designated coordinate as a surveillance region. In the example shown in FIG. 7, by designating a coordinate A0 (r0, θ0) as the center of a surveillance region, a hatched region represented by (r0±Δr0, θ0±Δθ0) is designated as the surveillance region.

Herein, as for a coordinate (r,θ), "r" denotes a distance from a center O of the circular image to the coordinate (r,θ), and "θ" denotes a central angle of the coordinate (r,θ) with respect to the center O of the circular image. Using these parameters r and θ, any positional coordinate over the circular image can be designated.

According to the second method, coordinates corresponding to four corners of a certain region (e.g., A1 (r1,θ1), A2 (r2,θ2), A3 (r3,θ3), and A4 (r4,θ4)) are designated by a key entry through the manipulation section 4. In this case, the region defined by the four points is set as a surveillance region. In this method, the surveillance region can be set so as to have any extent of area.

According to the present invention, not only one surveillance region but also a plurality of surveillance regions can be set using the above first method and/or second method.

Figure 8:
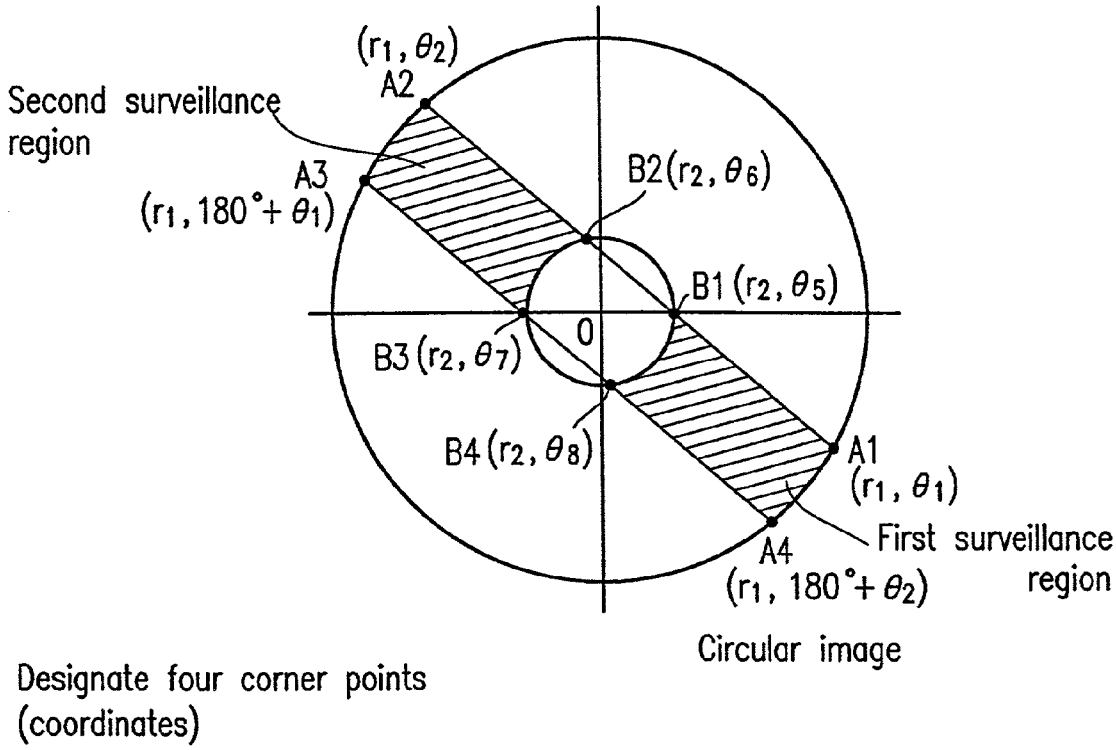
FIG. 8 illustrates a second example of the surveillance region setting processing.

FIG. 8 schematically shows a captured image obtained by a CCD camera which is used as the imaging section 1. A third method for setting a surveillance region is described below with reference to FIG. 8.

According to the third method, in a circular captured image displayed on the monitor, a pair of surveillance regions are set such that they are symmetrical with respect to the center O of a circular coordinate system. In the example shown in FIG. 8, by designating distance r1 from the center O of the circular coordinate system, and two central angles θ1 and θ2 from a reference position in the circular image, four points, A1 (r1,θ1), A2 (r1,θ2), A3 (r1,180°+θ1)), A4 (r1,180°+θ2), can be selected. As a result, a first surveillance region defined by points A1 (r1,θ1), B1 (r2,θ5), B4 (r2,θ8), and A4 (r1,180°+θ2), and a second surveillance region defined by points A2 (r1,θ2), B2 (r2,θ6), B3 (r2,θ7), and A3 (r1,180°+θ1)), can be simultaneously set.

Herein, all four points A2, B2, B1, and A1 are on a line. Further, all four points A3, B3, B4, and A4 are also on another line.

Figure 9:
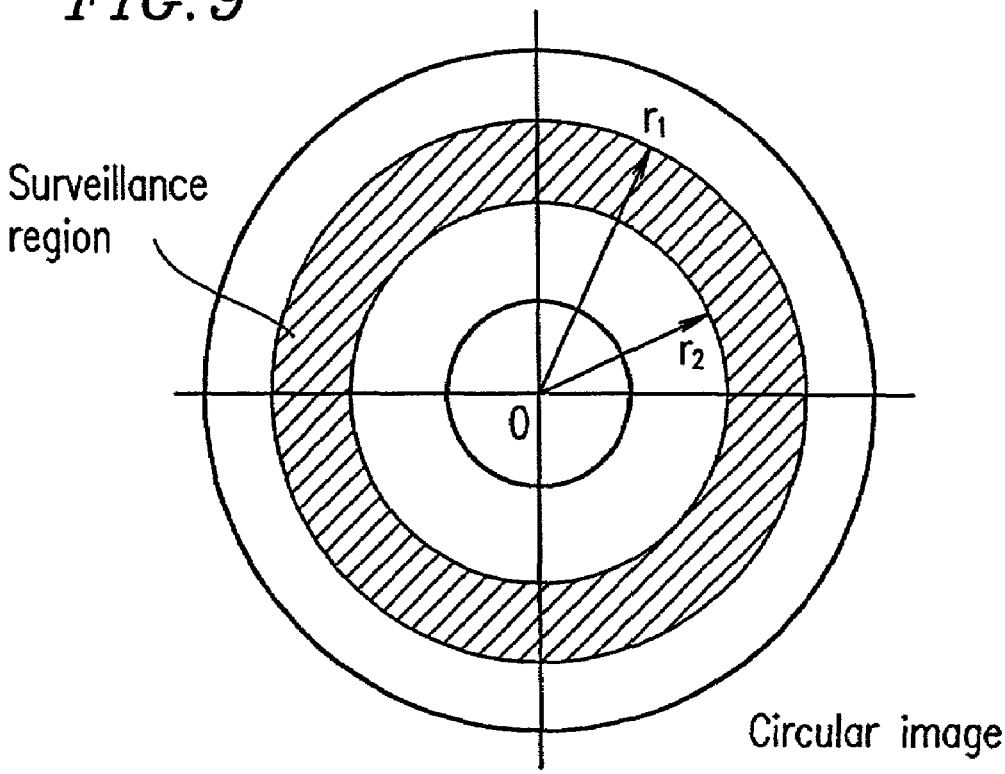
FIG. 9 illustrates a third example of the surveillance region setting processing.

FIG. 9 schematically shows a circular captured image obtained by the imaging section 1. A fourth method for setting a surveillance region is described below with reference to FIG. 9.

According to the fourth method, in a circular captured-image, by designating two different distances r1 and r2 from center coordinate O of the circular image, a ring-shaped surveillance regions defined by a circle having diameter r1 and a circle having diameter r2 can be set.

Now, consider a case where a region to be surveilled is a central area of a room, and an image surveillance apparatus of the present invention is installed above the region to be surveilled. In such a case, by using the fourth method to set a ring-shaped surveillance region, and observing the set surveillance region, every possible approach and intrusion into the surveillance region can be detected regardless of the direction in which the intruder approaches or intrudes into surveillance region. Furthermore, according to the fourth method, the surveillance region can be set by simply designating two different distances. That is, the fourth method is advantageous in that the surveillance region can be set in a very easy manner.

In any of the above first to fourth methods, a coordinate(s) is designated by a key entry through the manipulation section 4 which is connected via a communication line to the control section 2. For example, on the monitor screen provided together with the controller of the external device, a cursor key is slidden to a desired position, whereby a coordinate for defining a surveillance region can be designated. Alternatively, a coordinate can be designated by inputting coordinate parameters by a key entry operation. Alternatively, a touch panel formed over the monitor screen may be used as the manipulation section 4. In such an arrangement, a coordinate can be designated by directly touching the touch panel over the monitor screen.

A current image obtained by the imaging section 1 can be converted into a panoramic image or a perspective image by performing a key entry operation in the manipulation section 4 during the surveillance region setting processing. In this case, specifically, an instruction for image conversion is input through the manipulation section 4 and transmitted to the control section 2. The control section 2 recognizes the instruction and transmits image conversion instruction information to the image conversion section 12 of the image processing section 6. The image conversion section 12 converts a current circular image into a panoramic image, perspective converted image, etc., based on the image conversion instruction information.

For example, if a surveillant is not accustomed to observe a circular image as captured so that it is difficult for him/her to grasp relative directions in the circular image, the circular image is first converted to a panoramic image, for example. In the panoramic image, the surveillant can more easily grasp relative directions, and can readily set a desired surveillance region. Alternatively, if a surveillant has repeatedly utilized the surveillance monitor screen and is now accustomed to observe a circular image, he/she would already have a good grasp of the relative positions in a circular image. In such a case, the surveillant can readily set a desired surveillance region in the circular image, and the efficiency in the surveillance region setting operation is higher than a case where the above image conversion is performed.

Figure 10:
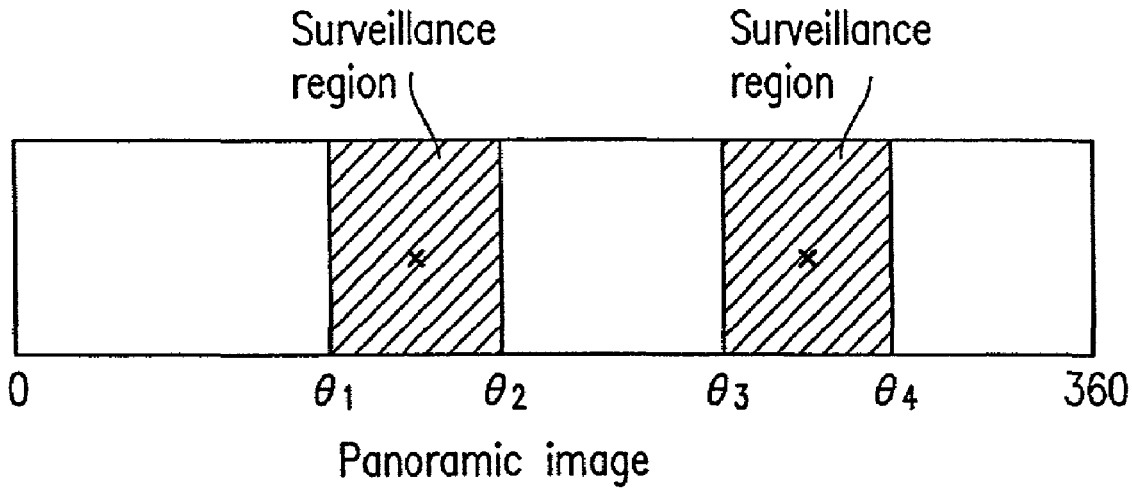
FIG. 10 illustrates a fourth example of the surveillance region setting processing.

FIG. 10 schematically shows a panoramic image including a plurality of surveillance regions. Methods for setting a plurality of surveillance regions are described below with reference to FIG. 10.

Herein, two exemplary methods for selecting a certain position for setting a surveillance region are described.

According to the first method, by designating the center coordinate of the surveillance region, a predetermined area of region is set as the surveillance region.

According to the second method, in a panoramic image obtained by converting a circular image, a distance from a reference point in the panoramic image is designated based on an angle from the reference point in the circular image, so as to set a surveillance region. In FIG. 10, surveillance regions are set by designating angular ranges (θ1,θ2) and (θ3,θ4), respectively. In this case also, a desired position can be designated by using the manipulation section 4, such as a cursor key, a touch panel, or the like, in the same manner as that used in setting a surveillance region in a circular image.

The positional information set for the surveillance region in this way is stored in the parameter storage region 14 of the storage section 3.

A method for converting a circular image as captured by the imaging section 1 into a panoramic image or a perspective converted image is described in detail in Japanese Patent Application No. 2000-152208, for example.

Next, the background image setting processing performed at step S02 is described in detail with reference to the flowchart of FIG. 11.

In the background image setting processing at step S02, at the first step, a current image is obtained by the imaging section 1 (step S21). The obtained current image is stored in the current image storage region 16 of the storage section 3. As described above, the current image data obtained by the imaging section 1 is stored in the current image storage region 16 of the storage section 3 together with time information which indicates the time when the current image data was obtained by the imaging section 1.

Next, the process proceeds to step S22. At step S22, the control section 2 determines whether or not the number of background images stored in the background image storage region 15 of the storage section 3 (each background image having time information which indicates the time when the background image was captured by the imaging section 1) is equal to or greater than a predetermined number of frames (N frames). If the number of background images stored in the background image storage region 15 of the storage section 3 is smaller than N frames, the current image data obtained by the imaging section 1 at step S21 is stored as background image data in the background image storage region 15 of the storage section 3 (step S27). Then, the process returns to step S21. In this way, until the number of background images stored in the background image storage region 15 of the storage section 3 reaches the N frames, current image data obtained by the imaging section 1 is sequentially stored as background image data in the background image storage region 15 by the background image registration section 9 of the image processing section 6.

Herein, by dealing with a plurality of frames (N frames) of background images as one unit, a misdetection of occurrence of an abnormal event due to a variation in the background of an image which is caused within a short period of time can be prevented. For example, consider a case where there is a flash light flashing at a certain frequency in a view field of the imaging section 1, and an image obtained by the imaging section 1 where the flash light is in its off period is set as a background image. If an image obtained by the imaging section 1 where the flash light is in its on period is selected as a current image, the difference between the on/off periods of the flash light, which should not be identified as an abnormal event (e.g., an intrusion of an external object), is misidentified by the control section 2 as an abnormal event. In such a case, an abnormal signal may be sent to the control section 2.

Under the above mentioned circumstances, if a plurality of frames (N frames) of background images are dealt with as one unit, an image obtained by the imaging section 1 where the flash light is in its on period is registered as one of the background images. Differences among the background images are totaled for comparison with a current image, i.e., non-significant variations in the background images are averaged. Thus, the probability that occurrence of an abnormal event is erroneously detected due to a non-significant variation in the background can be reduced. Further, in order to prevent a misdetection due to a variation which may be caused over a long time period, such as a variation in weather, illumination conditions, or the like, the background image unit (including N frames of background images) is updated at a predetermined time interval as described later. It should be noted that, in the case where the storage capacity of the storage section of the surveillance apparatus is small, or misdetection of occurrence of an abnormal event is small, the frame number of one background image unit may be 1.

If the number of background images stored in the background image storage region 15 of the storage section 3 is equal to or greater than the predetermined number of frames (N frames) which consist one background image unit. The process proceeds to step S23.

At step S23, according to an instruction by the background image registration section 9 of the image processing section 6, difference data of image is calculated by the image comparison section 10 based on differences between current image data (image data of 1 frame) and each of background image data included in a background image unit previously stored in the background image storage region 15 of the storage section 3. Then, in the image comparison section 10, the calculated difference image data is binarized using a certain threshold value stored in the parameter storage region 14 of the storage section 3 so as to obtain difference data of binarized image. The difference data of binarized image is temporarily stored in the difference image storage section 20 of the storage section 3.

The difference data of binarized image is obtained not for the entire view field range of an image obtained by the imaging section 1, but only for a preset surveillance region, in order to reduce the amount of calculation processing and thereby achieve a high processing speed. Furthermore, the threshold value used in binarization is set as a parameter by a surveillant by a key entry through the manipulation section 4 and stored in the parameter storage region 14 of the storage section 3.

Next, at step S24, based on the difference data of binarized image temporarily stored in the difference image storage section 20 of the storage section 3, histogram data for each of X- and Y-directions of a X-Y matrix formatted over the difference data of binarized image is produced by the determination section 11 of the image processing section 6 by summing up image data values of the difference data of binarized image on respective coordinates over the X-Y matrix in each column and row of the X-Y matrix (hereinafter, this processing is referred to as "projection processing"). The produced histogram data is stored in the histogram storage region 21 of the storage section 3.

Now, a general procedure of the projection processing is described in specific.

Figure 14:
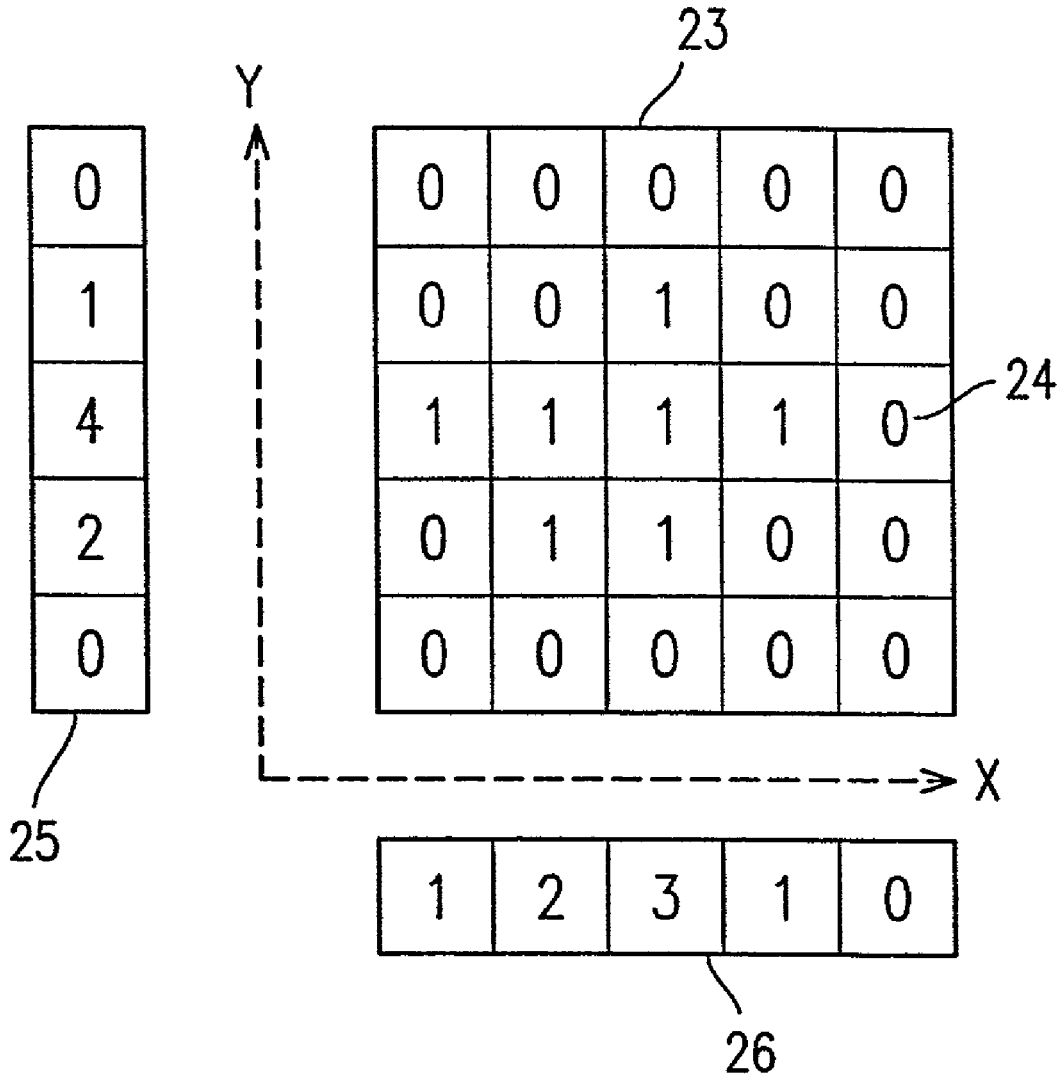
FIG. 14 illustrates an example of projection processing.

FIG. 14 schematically shows histogram data produced based on difference data of binarized image where a pixel arrangement is 5×5.

In the example illustrated in FIG. 14, each image value 24 in the 5×5 difference data of binarized image 23 is 0 or 1. Among pixels (X, Y) shown in FIG. 14, the pixel value on each of coordinates (3,4), (1,3) to (4,3), and (2,2) to (2,3) is 1, whereas the pixel value on each of the other coordinates is 0.

In this example, the histogram 26 along the X-direction is [1, 2, 3, 1, 0] from left to right, and the histogram 25 along the Y-direction is [0, 2, 4, 1, 0] upwardly. In this way, the projection processing is performed.

Figure 11:
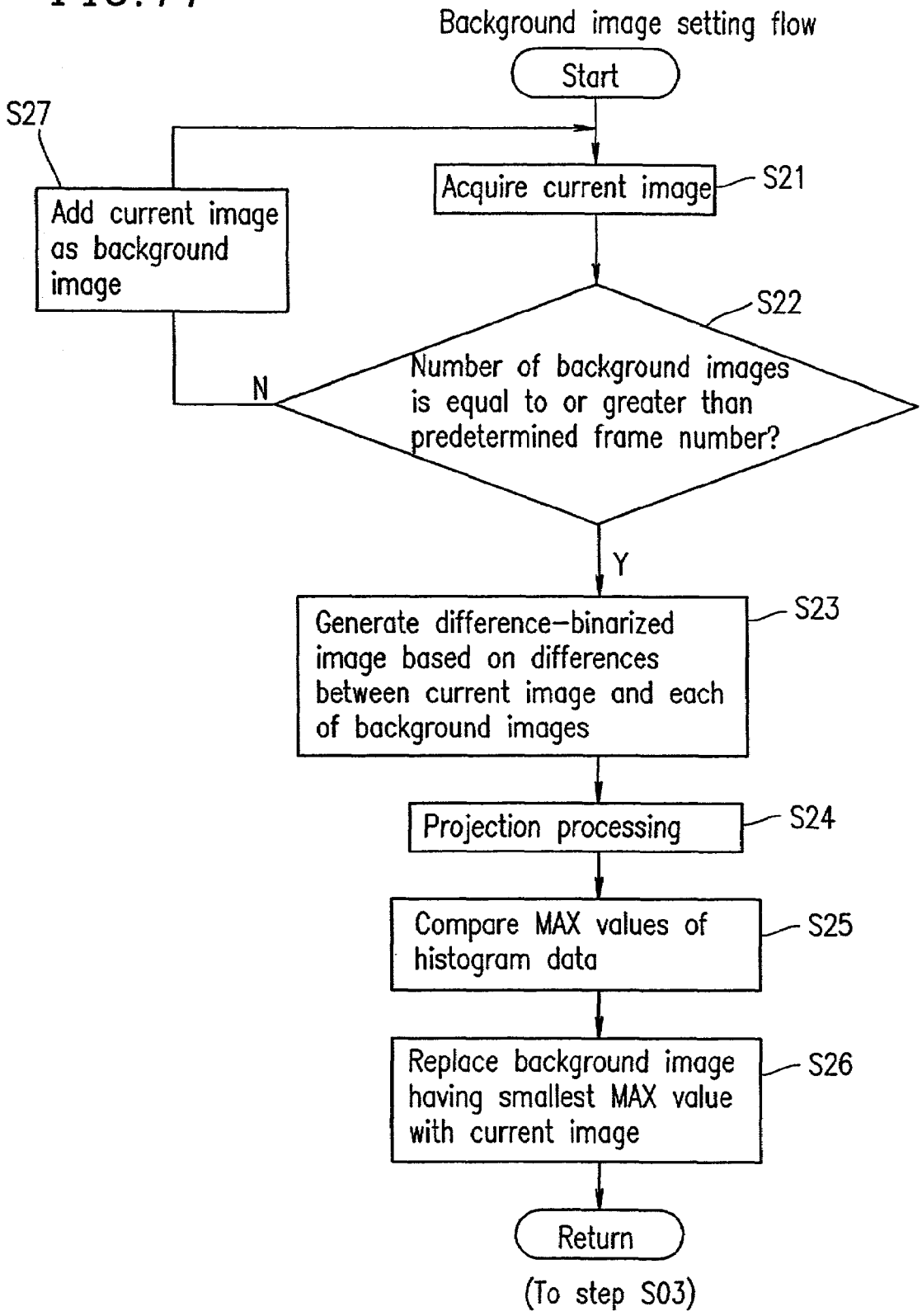
FIG. 11 is a flowchart which illustrates a general procedure of background image setting processing.

After the projection processing at step S24 has been completed, the process proceeds to step S25 of FIG. 11. At step S25, among the histogram data produced by the projection processing at step S24, the maximum values of the respective histogram data are compared, and a background image corresponding to histogram data having the smallest maximum value is selected.

Then, the selected background image is sent to the background image registration section 9, and the background image registration section 9 replaces the selected background image corresponding to histogram data having the smallest maximum value with current image data, and registers the replaced current image data as background image data (step S26).

In the above example, in the determination section 11, the maximum values of the respective extracted histogram data are compared for selecting background image data to be replaced with current image data. However, according to the present invention, the total sums of the pixel values of the respective histogram data may be compared, and background image data having the smallest total sum value may be replaced with current image data.

The background image setting processing is completed at the end of the processing at step S26, and the process flow returns to the main process flow shown in FIG. 5.

Figure 12:
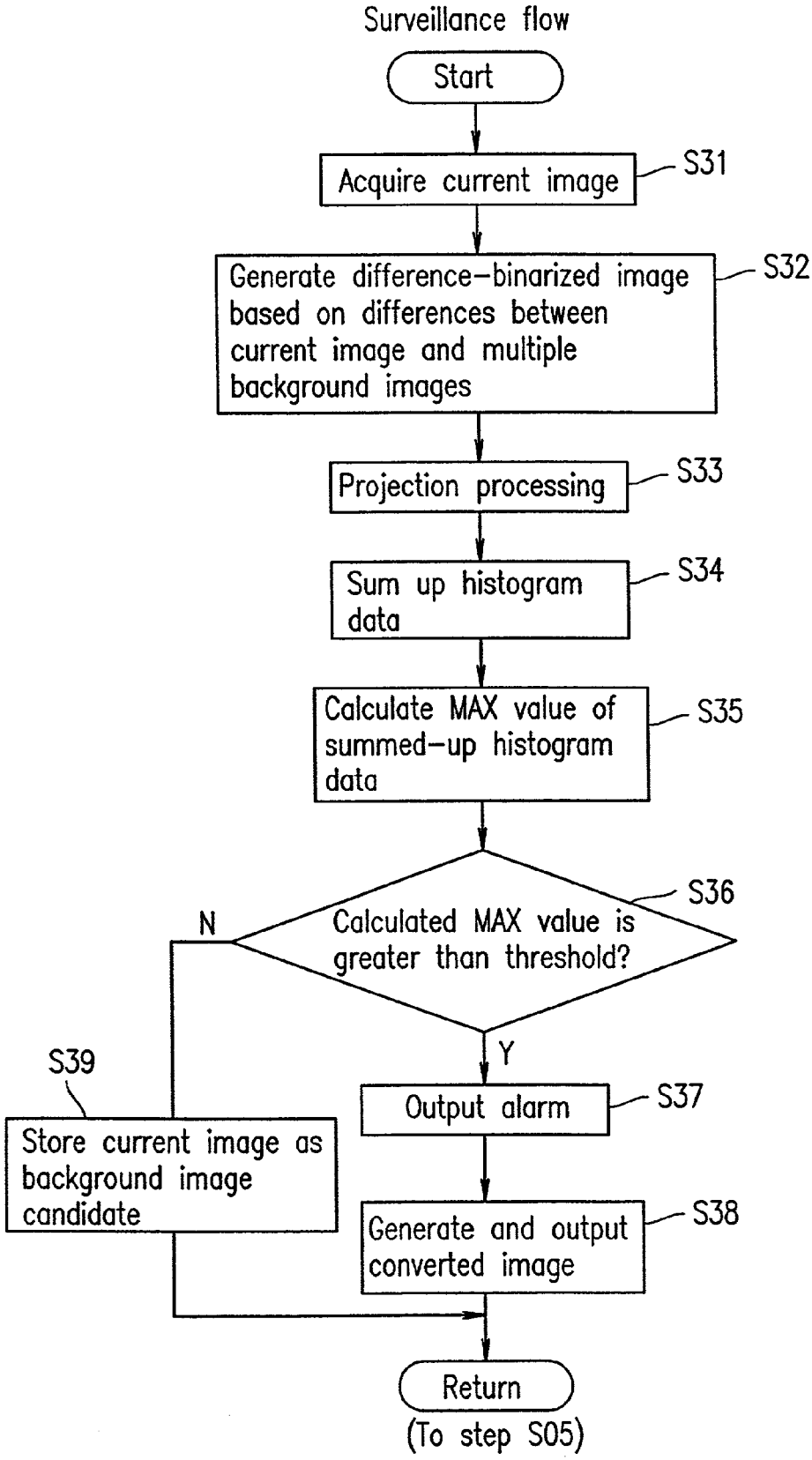
FIG. 12 is a flowchart which illustrates a general procedure of surveillance processing.

Next, the surveillance processing performed at step S04 is described in detail with reference to the flowchart shown in FIG. 12.

In the surveillance processing performed at step S04, at the first step, a current image (image data of 1 frame) is obtained by the imaging section 1 (step S31). Then, in the image comparison section 10 of the image processing section 6, the current image obtained by the imaging section 1 is compared, for each surveillance region, with each background image, included in a background image unit, previously stored in the background image storage region 15 of the storage section 3, so as to obtain difference-binarized image data (step S32). The difference-binarized image data is stored in the difference image storage section 20 of the storage section 3. In this processing, binarization calculation is performed not for the entire view field range of an image obtained by the imaging section 1, but only for a preset surveillance region, in order to reduce the amount of calculation processing and thereby achieve a high processing speed.

Then, on the obtained difference-binarized image data for each background image, the determination section 11 of the image processing section 6 performs projection processing for each surveillance region as described above (step S33).

Then, in the determination section 11, histogram data for the respective background images are summed up, and the summed-up result is stored in the histogram storage region 21 of the storage section 3 (step S34).

Then, in the determination section 11, the maximum value of the summed-up result stored in the histogram storage region 21 of the storage section 3 is calculated (step S35), and it is determined whether or not the calculated maximum value is greater than a threshold value (step S36). Note that the threshold value used in this processing is input through the manipulation section 4 and stored in the parameter storage region 14 of the storage section 3.

If the maximum value is greater that the threshold (reference) value at step S36, it is determined that an abnormal event occurred. The process proceeds to step S37. At step S37, an abnormal signal and information about a relevant surveillance region where the abnormal event occurred are transmitted to the control section 2. The control section 2 outputs to the alarm output section 7 an alarm instruction together with the information about the relevant surveillance region. The alarm output section 7 outputs to an external device connected thereto an alarm message or alarm sound together with the information about the relevant surveillance region.

On the other hand, an image conversion instruction is transmitted from the control section 2 to the image conversion section 12 of the image processing section 6. According to the image conversion instruction, the image conversion section 12 generates perspective converted image data such that a portion in the current image data which has the maximum value of the summed-up histogram data is positioned at the center of a X-Y coordinate system. The produced perspective converted image data is stored in the converted image storage region 17 of the storage section 3. Then, at step S38, the perspective converted image data stored in the converted image storage region 17 of the storage section 3 is output to the image output section 5 through the control section 2. The image output section 5 transmits the perspective converted image data to a controller (not shown) operated by a surveillant, for example. The perspective converted image data is displayed on a monitor (not shown) provided together with the controller. After that, the process flow returns to the main process flow shown in FIG. 5.

If the maximum value of the summed-up data of the histograms is not greater that the threshold value at step S36, the determination section 11 determines that there is nothing to be examined, i.e., there is no abnormal event occurred, i.e., everything is normal in the surveillance region. In such a case, processing for outputting an alarm and a perspective converted image is not performed, and current image data is stored as a background image candidate in the background image candidate storage region 22 of the storage section 3. Thereafter, the process flow returns to the main process flow shown in FIG. 5.

Next, the background image update processing performed at step S07 is described in detail with reference to the flowchart shown in FIG. 13.

The background image update processing of step S07 is begun if the control section 2 determines at step S06 of the main process flow shown in FIG. 5 that it is an appropriate time to update a background image unit. This update timing occurs at a time when a certain time period has elapsed after a time when a background image was obtained. According to the present invention, the certain time period is set to about 30 minutes to 1 hour, although it is influenced by a degree of variation in the background image. For example, consider a case where the image surveillance apparatus of the present invention is installed in a shop. In the case where the image surveillance apparatus is used for surveilling the inside of the shop after the shop is closed, the background image is not updated during a time period from a time when the shop is closed to a time when the shop is next opened. After the shop is opened, the background image is updated at a certain time interval.

Figure 13:
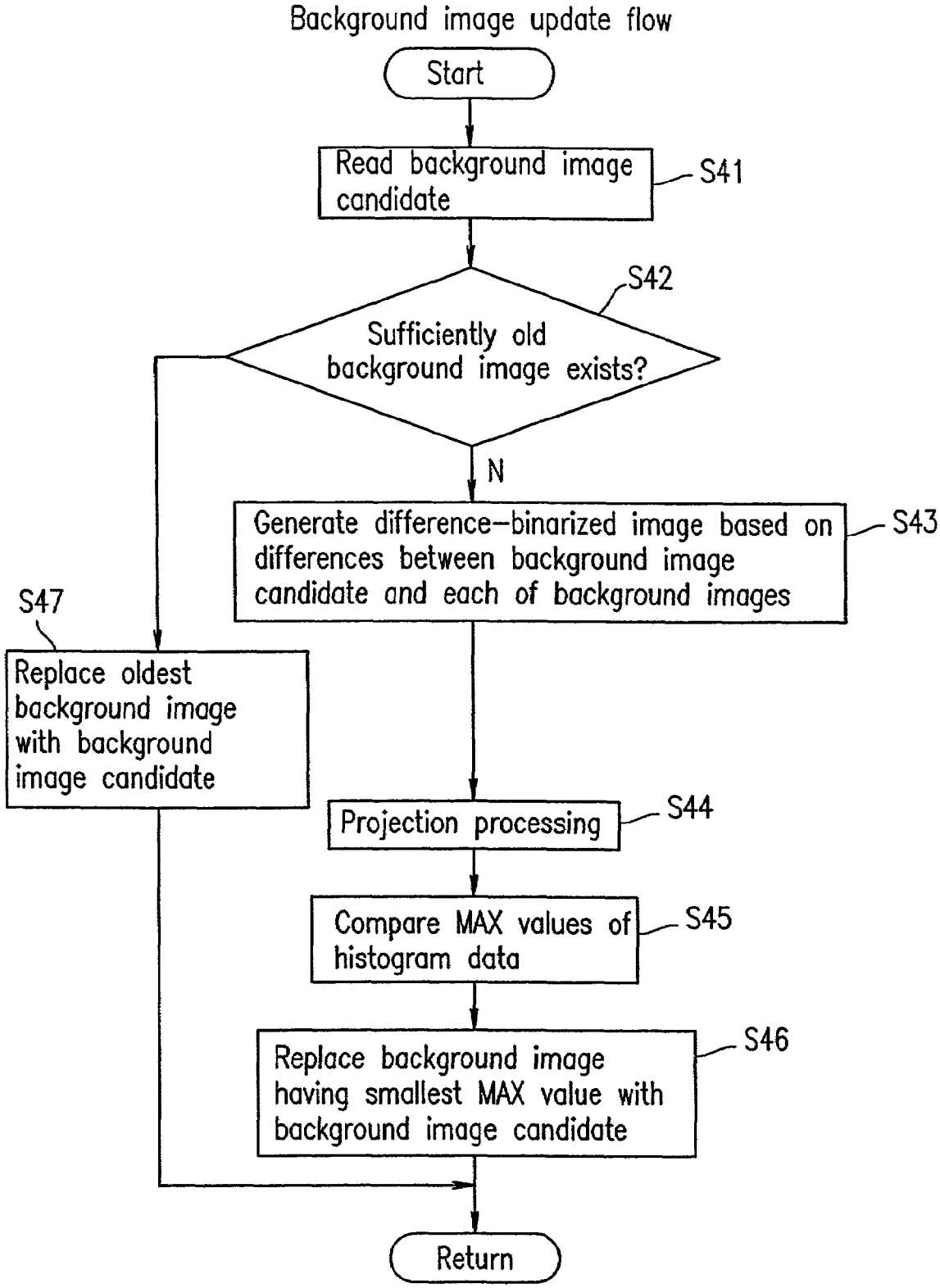
FIG. 13 is a flowchart which illustrates a general procedure of background image update processing.

If the control section 2 determines at step S06 of FIG. 5 that it is a predetermined time to update the background image, the background image update processing of step S07 is begun and then carried out according to the flow shown in FIG. 13. At the first step, a background image candidate, which has been stored in the background image candidate storage region 22 of the storage section 3 when it is determined at step S04 (FIG. 5) that there is no abnormal event occurred, is read out into the background image registration section 9 of the image processing section 6 (step S41).

Next, at step S42, it is determined, based on time information attached to respective image data stored in the background image storage region 15 of the storage section 3, that there is old background image data which has been aged for a certain time period or more in the background image registration section 9.

If there is old background image data which has been aged for a certain time period or more("Y" at step S42), the process proceeds to step S47.

At step S47, the old background image data which has been aged for a certain time period or more is deleted, and the background image candidate read out at step S41 is set as new background image data. If a plurality of background image data which has been aged for a certain time period or more are found, the oldest one of them is selected and replaced with the background image candidate.

If no background image satisfies such a criteria ("N" at step S42), the process proceeds to step S43.

At step S43, the image comparison section 10 of the image processing section 6 produces difference-binarized image data based on differences between the background image candidate and each of the background image data. The produced difference-binarized image data is stored in the difference image storage section 20 of the storage section 3.

Then, at step S44, projection processing is performed on each of the difference-binarized image data stored in the difference image storage section 20 of the storage section 3, so as to produce histogram data. The produced histogram data is stored in the histogram storage region 21 of the storage section 3.

After the projection processing at step S44 has been completed, the process proceeds to step S45. At step S45, among the histogram data produced by the projection processing at step S44, the maximum values of the respective histogram data are compared.

Then, a background image corresponding to histogram data having the smallest maximum value is selected, and this selected background image is replaced with the background image candidate (step S46).

After the entire processing of the background image data update processing has been completed, the process flow proceeds to the surveillance processing step at step S04 shown in FIG. 5.

According to the above-described operations, with a single image surveillance apparatus, any desired region in an omniazimuthal view field image obtained by an omniazimuthal camera of the image surveillance apparatus can be set as a surveillance region. In the case where an object to be examined is detected in the surveillance region, image conversion can be performed in a smooth manner so that a perspective converted image or the like is obtained. Furthermore, according to the present invention, there is provided a plurality of background images for comparison with a current image. Thus, an undesired influence caused by a variation in the background of an image is reduced, and accordingly, detection accuracy for detecting an object to be examined is improved.

An image surveillance apparatus of the present invention includes an imaging section which has a convex mirror having a shape of a body of rotation and is capable of obtaining an image from a 360° (omniazimuthal) view field area. Only with a single imaging section having such a structure, a plurality of regions, each of which is present in any direction seen from the imaging section, and which is defined by any shape of boundary line, can be set as surveillance regions. Thus, it is not necessary to provide a plurality of surveillance apparatuses, or to provide a driving mechanism for moving the imaging section for the purpose of obtaining an image from any desired direction. Without such an additional arrangement, the surveillance apparatus of the present invention can monitor a wide range of surveillance region(s).

Furthermore, in the case where an object to be examined is detected, an image processing section performs image conversion so as to generate a perspective converted image including the object to be examined. With such a perspective image, the object can be examined readily and smoothly. Further still, since detection of an abnormal event is performed based on a comparison between a plurality of background images and a current image, an undesired influence caused by a variation in the backgrounds of the images is reduced, and accordingly, detection accuracy for detecting an object to be examined is improved.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An image surveillance apparatus, comprising:

an imaging section including a convex mirror having a shape of a body of rotation, the imaging section obtaining an image of an omniazimuthal region and generating image data of the omniazimuthal region;

a surveillance region setting section for setting a surveillance region in the image data of the omniazimuthal region which is obtained from the imaging section, wherein at least one coordinate is designated for defining the surveillance region as a predetermined area of the image less than the entire image an image processing section for performing image processing according to determination information obtained from a comparison/determination between background image data obtained by the imaging section in advance, which is used as a reference that represents a normal state of the surveillance region, and current image data obtained by the imaging section at a predetermined time interval; and a surveillance information output section for outputting surveillance information according to the determination information.

2. An image surveillance apparatus according to claim 1, wherein the surveillance information output section is an image output section.

3. An image surveillance apparatus according to claim 1, wherein the image processing section includes:

an image comparison section for comparing the background image data and the current image data;

a determination section for determining the presence/absence of an object to be examined based on a comparison result of the image comparison section; and an image conversion section for performing certain image conversion processing based on the determination result of the determination section.

4. An image surveillance apparatus according to claim 1, wherein the surveillance region setting section sets a plurality of surveillance regions.

5. An image surveillance apparatus according to claim 1, wherein the image processing section converts the image data of the omniazimuthal region, which is obtained by the imaging section, into panoramic image data or perspective converted image data.

6. An image surveillance apparatus according to claim 1, further comprising an alarm information output section for outputting alarm information when the image processing section determines that the current image data is different from the background image data.

7. An image surveillance apparatus according to claim 3, wherein:

the image comparison section generates comparison result image data based on a difference between the background image data and the current image data; and the determination section performs projection processing based on a comparison result for each surveillance region.

8. An image surveillance apparatus according to claim 1, wherein time information, which indicates the time when the background image data was obtained, is attached to the background image data.

9. An image surveillance apparatus according to claim 1, wherein:

the image data obtained by the imaging section is circular image data; and the surveillance region is set based on a polar coordinate system where a center of the circular image data is an origin of the system.

10. An image surveillance apparatus according to claim 1, wherein:

the image data obtained by the imaging section is circular image data; and a ring-shaped region is set as the surveillance region by designating two distances from a center of the circular image data.

11. An image surveillance apparatus according to claim 1, wherein:

the image data obtained by the imaging section is circular image data; and a pair of symmetric regions are set as the surveillance regions by designating two distances from a center of the circular image data and two central angles.

12. An image surveillance method using an imaging section which includes a convex mirror having a shape of a body of rotation, the imaging section obtaining an image of an omniazimuthal region, comprising:

a surveillance region setting step of setting a desired surveillance region in omniazimuthal image data obtained by the imaging section, the surveillance region setting step including designating at least one coordinate for defining the surveillance region as a predetermined area of the image less than the entire image;

a background image setting step of setting a plurality of image data obtained by the imaging section as background image data which are used as a reference that represent a normal state of the surveillance region; and a surveillance step of surveilling the presence/absence of an abnormal event in the surveillance region based on a comparison result between the plurality of background image data and current image data obtained by the imaging section at a predetermined time interval.

13. An image surveillance method according to claim 12, further comprising a background image update step of updating the background image data when a predetermined time has elapsed after the setting of the background image data based on the predetermined elapsed time.

14. An image surveillance method according to claim 13, wherein the surveillance step includes:

a difference-binarized image generation step of acquiring the current image data obtained at a predetermined time interval, and generating difference-binarized image data based on a comparison performed for each surveillance region between the current image data and the background image data;

a projection step of performing projection processing on the difference-binarized image data for each surveillance region;

a maximum value calculation step of summing up data obtained by the projection processing and calculating a maximum value of the summed-up result;

a determination step of determining whether or not the calculated maximum value is greater than a predetermined threshold value; and an alarming step of outputting at least an alarm or converted image data produced from current image data in a certain region when it is determined that the calculated maximum value is greater than the predetermined threshold value.

15. An image surveillance method according to claim 13, further comprising a storage step of storing the current image data as a background image candidate in a storage section when it is determined in the determination step that the calculated maximum value is not greater than the predetermined threshold value.

16. An image surveillance processing program embodied in a computer-readable medium for executing the image surveillance method recited in claim 12.

* * * * *